US005799670A

United States Patent [19]

Rondeau

[11] Patent Number: 5,799,670

[45] Date of Patent: Sep. 1, 1998

[54] ROLLER-SET STYLING HAIRBRUSH

[76] Inventor: James Rondeau, P.O. Box 50, Bartansville, Pa. 18301

[21] Appl. No.: 611,562

[22] Filed: Mar. 6, 1996

[51] Int. Cl.[6] ..... A45D 7/00

[52] U.S. Cl. ..... 132/210; 132/237; 132/241; 132/242; 132/245

[58] Field of Search ..... 132/210, 223, 132/255, 254, 256, 237, 241, 242, 250, 245, 248, 249, 258, 259, 260

[56] References Cited

U.S. PATENT DOCUMENTS

| | | | |
|---|---|---|---|
| 3,135,269 | 6/1964 | Pauldine | 132/232 |
| 3,204,646 | 9/1965 | Chamberlin | 132/250 |
| 3,205,901 | 9/1965 | Moore | 132/254 |
| 3,340,880 | 9/1967 | Gresham et al. | 132/260 |
| 3,593,724 | 7/1971 | Leal | 132/254 |
| 3,955,064 | 5/1976 | Demtrio et al. | 132/232 |
| 4,502,496 | 3/1985 | Thomas et al. | 132/250 |

*Primary Examiner*—Gene Mancene
*Assistant Examiner*—Pedro Philogene
*Attorney, Agent, or Firm*—Jean-Marc Zimmerman

[57] ABSTRACT

A styling hairbrush which utilizes styling hair rollers of variable lengths and diameters, the rollers being easily mounted onto and easily removed from a control wand, and the rollers being surfaced with a velcro-like material for gripping the hair to be styled.

4 Claims, 2 Drawing Sheets

ROLLER-SET STYLING HAIRBRUSH

FIELD OF THE INVENTION

This invention relates generally to styling hairbrushes and more particularly to a hairbrush which has detachable rollers surfaced with a velcro-type material thus allowing the hairbrush to be removed from hair without getting entangled in the hair, the rollers being of varying diameter to accommodate and style hair of varying lengths.

BACKGROUND OF THE INVENTION

Combs and hairbrushes are commonly used to style and groom hair.

Styling hairbrushes are often used in conjunction with a hand held hair dryer to groom and style wet hair. Styling hairbrushes are well known in the prior art. See U.S. Pat. No. 4,664,132 and DESIGN U.S. Pat. No. 275,712. Styling hair rollers, which are well known in the prior art, are also commonly used to style hair. In particular, the use of hair rollers and a full head hair dryer enables one to obtain a smoother, fuller look and/or more curls and shapeliness in a particular hairstyle than can be obtained by simply using a hairbrush and a hand held air dryer. Conventional hair rollers have several drawbacks. First, hair rollers are most commonly applied to wet hair. Thus, the individual in whose hair the hair rollers have been placed must typically sit beneath a full head hair dryer and wait for their hair to dry and for the style to be set before the rollers can be removed.

Since most individuals do not own a full head hair dryer, the use of hair rollers typically requires a visit to a hair salon. Such visits typically involve a significant amount of time since the hair to be styled must be washed or otherwise made wet, hair rollers must then be put in place, and finally the individual whose hair is being styled must sit beneath a full head hairdryer and wait for their hair to dry. Furthermore, going to a salon to have hair rollers placed in ones hair and then sitting under a full head hair dryer is usually fairly expensive. A final disadvantage encountered in using conventional hair rollers is that such rollers are difficult to use because they have no handles with which to hold and position the rollers. In addition, conventional hair rollers, as well as conventional hairbrushes, can be painful to use because the bristles get entangled in the hair being styled, and/or because the bristles rub against and irritate the scalp.

It is, therefore, an object of the present invention to provide a styling hairbrush which overcomes all of the foregoing disadvantages. Since the use of the styling hairbrush disclosed and claimed herein together with a hand held hair dryer will enable consumers to obtain a professional looking roller-style type setting without having to place styling hair rollers their hair and then sit beneath a full head hair dryer waiting for their hair to dry, the present invention significantly reduces the time factor involved in obtaining a final setting. Time spent styling hair is also reduced because the present invention can style larger amounts of hair at one time than can conventional hairbrushes and rollers . Additional time is also saved since the styling hair-brush which is the subject of the present invention can be used to roller-style set dry hair. Also, the use of styling hair rollers having a velcro-like exterior surface instead of the bristles found on conventional hair rollers and hairbrushes, enables the hair being styled to be rolled all the way down to the scalp, while still allowing the brush and rollers to be removed without any difficulty. Moreover, the use of styling hair rollers having a velcro-like exterior surface eliminates the painful tangling of hair and/or irritation to ones scalp often associated with the use of conventional styling hair rollers and hairbrushes. Also, the present invention eliminates the difficulty and fumbling around associated with conventional hair rollers since the present invention includes a handle. Finally, the present invention allows a professional looking roller-style set to now be obtained in the convenience of ones home without having to spend the time or money of going to and the sitting and waiting in a hair salon.

SUMMARY OF THE INVENTION

A styling hairbrush having changeable styling hair rollers of varying diameters to style hair of different lengths, the exterior of said rollers being covered with a velcro-type material to adhere to the hair being styled, and the styling hairbrush having a mechanism for securing the rollers onto, and releasing the rollers from said hairbrush. The styling hairbrush also permits larger amounts of hair to be styled at one time than can be styled using conventional hairbrushes and hair rollers.

DETAILED DESCRIPTION OF THE DRAWINGS

Figure 1:
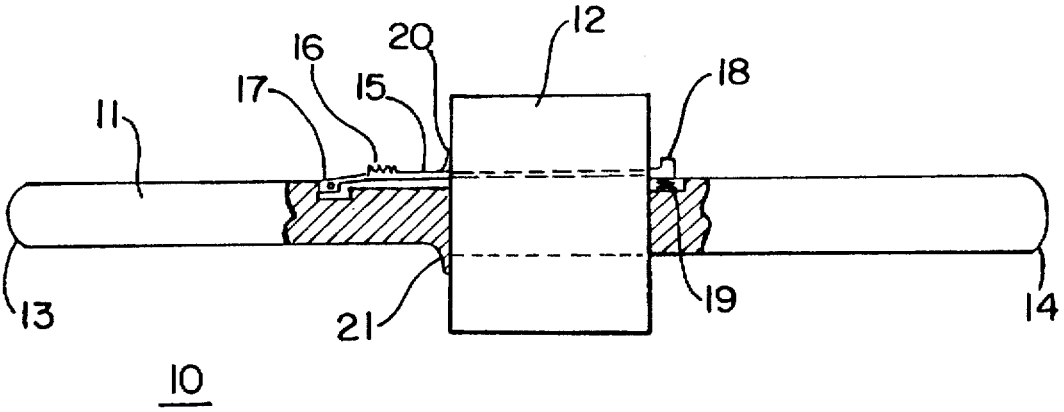
FIG. 1 shows a side view of an exemplary embodiment of the styling hairbrush disclosed and claimed in the subject application.

Referring to FIG. 1 there is shown a side view of styling hairbrush 10 according to this invention. Styling hairbrush 10 is comprised of control wand 11 and style roller 12. Control wand 11 includes first end 13 and second end 14. Positioned on the top of control wand 11 between first end 13 and second end 14 is thumb catch mechanism 15. Thumb catch mechanism 15 includes press plate 16, first end 17 and second end 18. First end 17 is hingedly coupled to the top of control wand 11 in recessed area 19, while second end 18 protrudes perpendicularly upwards from recessed area 19 above the top of control wand 11. Control wand 11 also includes first stop 20 and second stop 21. First stop 20 protrudes perpendicularly upward from the top of control wand 11 while second stop 21, which is parallel to and directly aligned with fist stop 20, protrudes perpendicularly downward from the bottom of control wand 11.

Control wand 11 is used in conjunction with style roller 12 to style hair. Control wand 11 may have a textured surface to ensure proper gripping while styling hair. To accomplish different styling applications and to accommodate hair of varying lengths, style roller 12 can be of varying diameters and lengths. Style roller 12 includes aperture 22 which is larger than the diameter of control wand 11, thereby allowing style roller 12 to accept and be slidably moved along control wand 11. Style roller 12 is placed onto control wand 11 by inserting second end 14 of control wand 11 into aperture 22.

Pressing down on press plate 16 causes second end 18 to recede into recessed area 19. Style roller 12 can then be slidably moved along control wand 11 towards first end 13 until style roller 12 abuts and is stopped from moving along control wand 11 by first stop 20 and second stop 21, at which point press plate 16 can be released. Releasing press plate 16 will cause second end 18 to emerge from recessed area 19 and to again protrude perpendicularly above the top of control wand 11. Second end 18 will also abut style roller 12 on the side of style roller 12 closest to second end 14. In this manner, style roller 12 is secured to control wand 11. Thumb catch mechanism 15 can be spring-loaded.

Style roller 12 can be removed from control wand 11 by pressing press plate 16 downwards which will cause second end 18 to recede into recessed area. Style roller 12 can then be slidably moved along control wand 11 towards second end 14 until control wand 11 is fully retracted from aperture 22.

Figure 2:
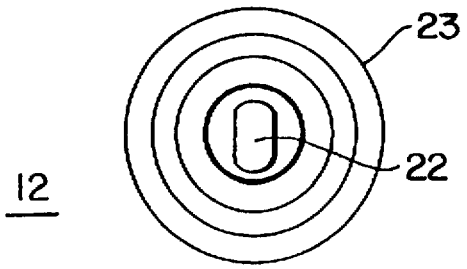
FIG. 2 shows a front view of a style roller used with the styling hairbrush shown in FIG. 1.

FIG. 2 shows a front view of style roller 12. Style roller 12 includes exterior surface 23, first end 24 and second end 25. Exterior surface 23 is covered with a velcro-like material used to grip the hair which is being styled. Exterior surface 23 can be covered with any material able to easily and painlessly adhere to hair. The shape of aperture 22 is identical to the shape of the width of control wand 11 so that style roller 12 can fit over and slidably move along control wand 11. In addition, having the same shape also prevents style roller 12 from being crushed or otherwise deformed while it is being used. Even though style roller 12 can be of varying diameters and/or lengths, the diameter of aperture 22 for each particular style roller 12 will be identical so that each particular style roller 12 can be slidably moved along and securely positioned onto control wand 11 regardless of its respective diameter or length.

Figure 3:
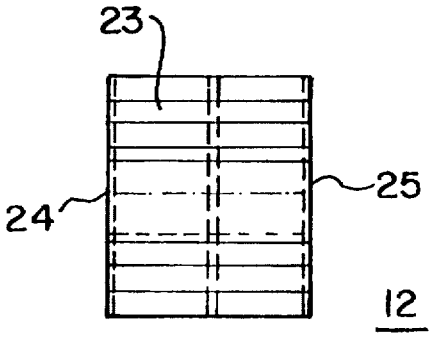
FIG. 3 shows a side view of the style roller shown in FIG. 2.
Figure 4:
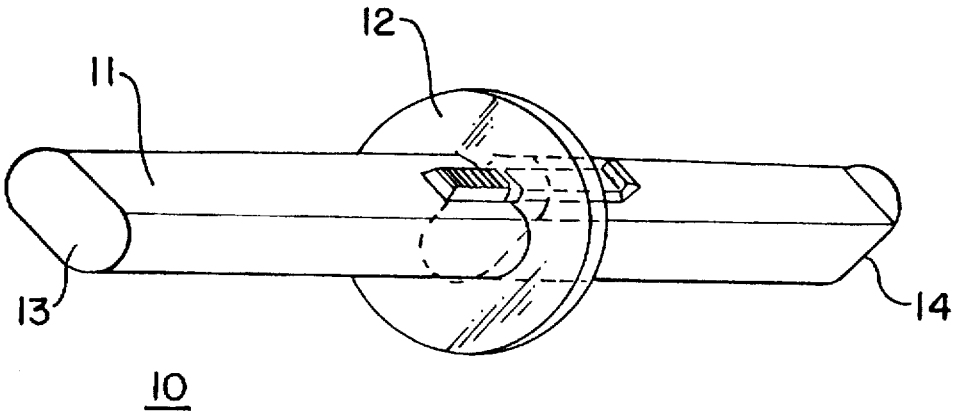
FIG. 4 shows a top right side perspective view of the styling hair-brush shown in FIG. 1.
Figure 5:
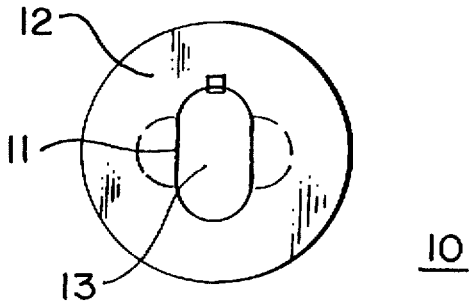
FIG. 5 shows a front view of the styling hairbrush shown in FIG. 1.

FIG. 3 shows a side view of style roller 12. Style roller 12 includes first end 24 and second end 25. FIG. 4 shows a right top side perspective view of the styling brush which is the object of the present invention. FIG. 5 shows a front view of the styling brush which is the object of the present invention.

Styling hairbrush 10 can be fabricated in any desired shape or size and from any material. It will be understood that the embodiment described herein is merely exemplary and that a person skilled in the art may make many variations and modifications to the described embodiment utilizing functionally equivalent elements to those described. Any variations or modifications to the invention just described are intended to be included within the scope of said invention as defined by the appended claims.

What is claimed is:

1. A roller-set styling hairbrush comprising:

a wand having a first end, a second end and a recessed area positioned between said first end and said second end, said wand further having a catch mechanism partially positioned in said recessed area, said catch mechanism having a first catch mechanism end and a second catch mechanism end, said first catch mechanism end being hingedly coupled to said wand and being positioned in said recessed area, said second catch mechanism end having a flange protruding from said recessed area, said wand further having a first flange stop and a second flange stop, said first flange stop and said second flange stop being positioned on opposite sides of said wand, said second flange stop being directly aligned with said first flange stop; and a hair roller having a first hair roller end and a second hair roller end, wherein pressing down on said catch mechanism causes said second catch mechanism end to be lowered into said recessed area thereby enabling said hair roller placed onto said wand at said second end to be slidably moved along said wand towards said first flange stop and said second flange stop, and wherein releasing said catch mechanism causes said second catch mechanism end to rise from said recessed area thereby enabling said roller to be securely positioned onto said wand between said first flange stop and said second flange stop at said first hair roller end, and said second catch mechanism end at said second hair roller end.

2. The roller-set styling hairbrush according to claim 1, wherein said catch mechanism is spring-loaded.

3. The roller-set styling hairbrush according to claim 1, wherein said flange of second catch mechanism end is perpendicularly positioned with respect to said wand.

4. The roller-set styling hairbrush according to claim 1, wherein said first flange stop and said second flange stop are perpendicularly positioned on opposite sides of said wand.

* * * * *